United States Patent [19]

Mandell

[11] 4,339,833

[45] Jul. 20, 1982

[54] RECIPROCATING HYDRO-MASSAGE APPARATUS

[76] Inventor: Gerald D. Mandell, 5427 N. Bryn Mawr, Ventura, Calif. 93003

[21] Appl. No.: 221,838

[22] Filed: Dec. 31, 1980

[51] Int. Cl.[3] ..... A47C 19/12

[52] U.S. Cl. ..... 4/542; 4/541; 4/492; 128/66

[58] Field of Search ..... 4/542, 541, 492, 490, 4/496, 596, 605, 606, 615; 128/66

[56] References Cited

U.S. PATENT DOCUMENTS

| | | | |
|---|---|---|---|
| 2,587,335 | 2/1952 | Landergott | 4/542 |
| 2,591,252 | 4/1952 | Gilson | 4/542 |
| 3,571,818 | 3/1971 | Jacuzzi | 4/542 |
| 3,616,466 | 11/1971 | Davis | 4/191 |
| 3,768,462 | 10/1973 | Boulard | 4/606 |
| 3,806,964 | 4/1974 | Vanegas et al. | 4/542 |
| 3,820,173 | 6/1974 | Weller | 4/496 |
| 3,874,374 | 4/1975 | Jacuzzi | 128/66 |
| 4,271,543 | 6/1981 | Martin | 4/596 X |

*Primary Examiner*—Henry K. Artis
*Attorney, Agent, or Firm*—Max E. Shirk

[57] ABSTRACT

A hydro-jet-type nozzle reciprocably mounted in an elongated slot adjacent which a user of the device may position a body portion to be massaged by the hydro jet.

9 Claims, 16 Drawing Figures

RECIPROCATING HYDRO-MASSAGE APPARATUS

BACKGROUND OF THE INVENTION

1. Field of the Invention

This invention relates generally to the field of massaging devices and more particularly to a new and useful reciprocating hydro-massage apparatus.

2. Brief Description of the Prior Art

The prior art known to applicant comprises the following U.S. patents:

| U.S. Pat. No. | Patentee | Date Issued |
|---|---|---|
| 2,591,252 | W. E. Gilson | April 1, 1952 |
| 2,587,335 | A. F. Landergott | Feb. 26, 1952 |
| 3,571,818 | R. A. Jacuzzi | Mar. 23, 1971 |
| 3,616,466 | O. T. Davis | Nov. 2, 1971 |
| 3,820,173 | Elmar Weller | June 28, 1974 |
| 3,874,374 | R. A. Jacuzzi | Apr. 1, 1975 |

Gilson discloses a portable hydrotherapy tank in which a nozzle 52 may be positioned at different heights by turning handwheel 56. However, Gilson leads away from continuously reciprocating the nozzle by providing handle 58 for locking the nozzle in predetermined positions.

Landergott also discloses a hydrotherapy tank in which a nozzle may be moved to predetermined vertical positions by actuating a hand crank.

Jacuzzi '818 discloses a self-contained hydrotherapy tank of the hip type having an interior seat forming an exterior chamber, and a built-in hydromassage system including a hydro-air jet head assembly mounted in a wall of the tank, a pump installed in the exterior chamber, the pump having its suction end flow-connected with the interior of the tank, and its discharge end connected to the hydro-air jet head assembly. An adjustable heater is provided in the system to maintain the temperature of water within a desired temperature range.

Davis discloses a shower head vertically adjustable as to height which includes an elongated casing having an elongated slot for the projecting shower head in its sidewall which faces the rear of the shower stall so that the casing as viewed from the front of the shower stall presents an unbroken attractive appearance.

Jacuzzi '374 discloses a hydro-massage tub with jet heads installed in the corners thereof; it has a control panel for adjusting air intake to the various jet heads, and includes an induction air control system which precludes flooding in the event any of the nozzles of the various jet heads should be blocked from discharging.

Weller is of interest as showing the state of the art.

SUMMARY OF THE INVENTION

The present invention is directed, in brief, to the provision of a new and useful reciprocating hydro-massage apparatus.

The best mode currently contemplated for carrying out the invention includes the provision of a housing member having at least one wall with an elongated opening provided therein. A suitable nozzle, which may be a hydro-jet nozzle, is reciprocally mounted in the housing adjacent the rear face of the wall in fluid communication with the elongated opening. A suitable device, such as a double-helix screw or the like, is coupled to the nozzle for reciprocating it with respect to the elongated opening. In one form of the present invention, the screw is rotated by an electric motor; in another form, the screw is stationary and the nozzle is reciprocated by a fluid-driven impeller provided in the nozzle and coupled to a travelling coupling on the screw. A suitable supply of a fluid, such as water and air, is connected to the nozzle by flexible conduits for supplying the fluid to the elongated opening, whereby a user of the hydro-massage apparatus may position a body part adjacent the elongated opening and the front face of the wall for massaging the body part.

In a first embodiment of the present invention, the elongated opening is provided in the encompassing sidewall of a hot tub; in a second embodiment, the elongated opening is sealed by a flexible diaphragm adapted to be flexed by a hydro-jet from the nozzle. The housing may then be mounted in a suitable member adapted to support a body part. As shown herein for purposes of illustration, but not of limitation, the housing is mounted in the backrest of an automobile seat. It will be apparent to those skilled in the art that the hydro-massage apparatus may also be mounted in a water bed, mattress, truck seat, airplane seat, chair lounge and the like.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which like reference characters refer to like elements in the several views.

DESCRIPTION OF THE PREFERRED EMBODIMENT

Figure 1:
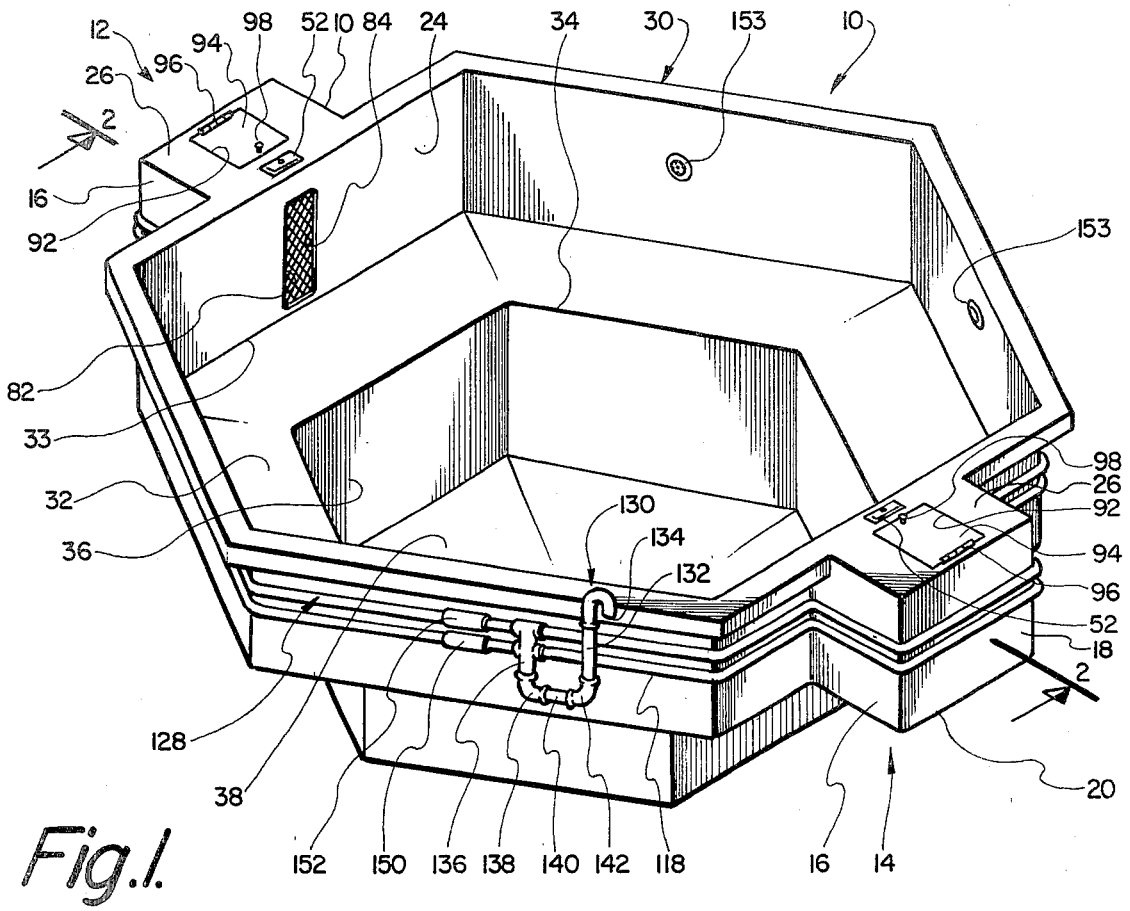
FIG. 1 is a perspective view of a reciprocating hydro-massage apparatus of the present invention.
Figure 2:
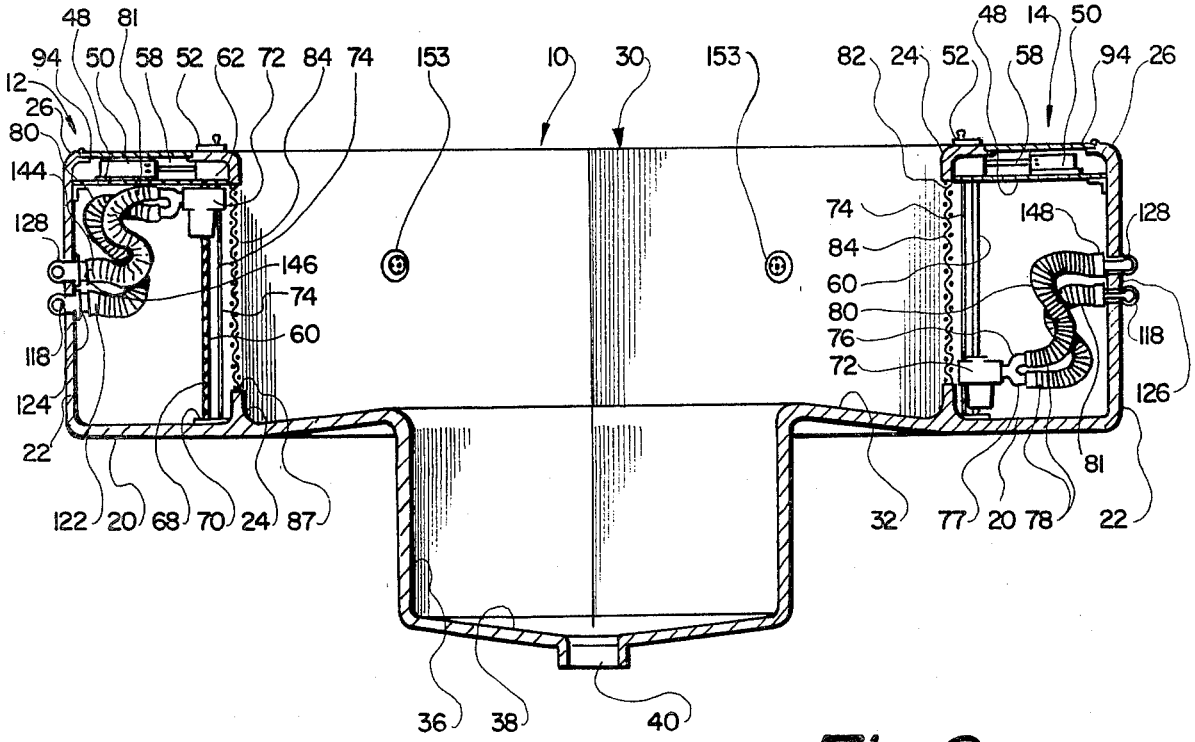
FIG. 2 is a cross-sectional view taken along line 2—2 of FIG. 1.

Referring again to the drawings, and more particularly to FIGS. 1 and 2, a reciprocating hydro-massage apparatus constituting a first embodiment of the present invention, generally designated 10, includes a first housing 12 and a second housing 14 each having a front wall 16, a rear wall 18, a bottom wall 20, an outer sidewall 22, an inner sidewall 24 and a top wall 26.

The inner sidewall 24 of each housing 12, 14 is also the encompassing sidewall of a hot tub 30 shown herein for purposes of illustration, but not of limitation, as having a hexagonal configuration. Hot tub 30 includes a horizontal platform 32 extending inwardly from the lower edge 33 of sidewall 24 and having an inner edge 34 from which a hexagonal skirt 36 depends into engagement with a bottom wall 38. A drain opening 40 is provided in bottom wall 38.

Figure 4:
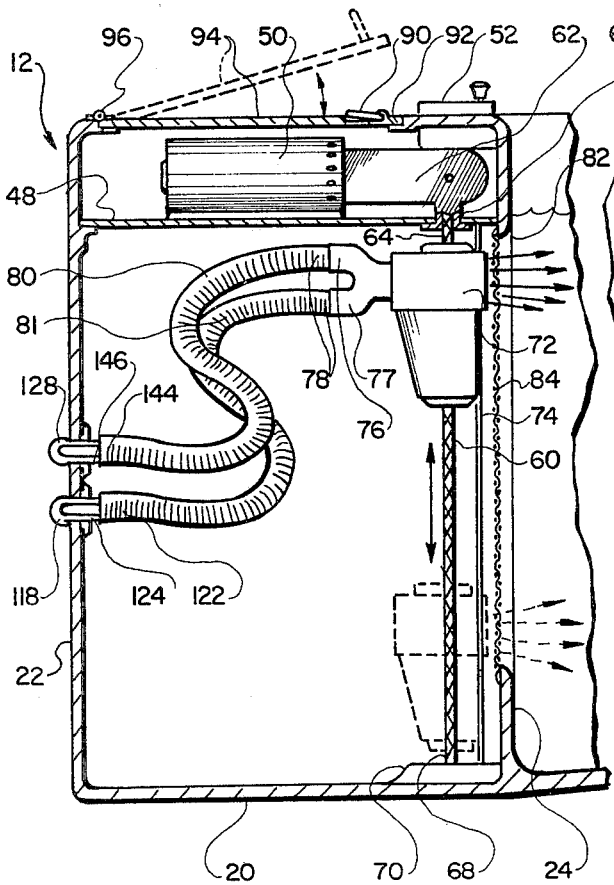
FIG. 4 is an enlarged cross-sectional view of the hydro-massage apparatus of FIG. 1.

Referring now to FIGS. 2 and 4, a horizontal partition 48 is removably mounted in each housing 12, 14 for supporting an electric motor 50, which is preferably of small voltage, such as a 12 volt D.C. motor and which is controlled by a suitable rheostat 52. The output shaft 58 of motor 50 is drivingly connected to a drive screw 60 by suitable gearing (not shown) mounted in a gear box 62 to motor 50 and partition 48.

Drive screw 60, which is preferably of the double-helix type, has an upper end 64 (FIG. 4) journaled in a bearing 66 carried by gear box 62 and a lower end 68 journaled in a bearing 70 affixed to bottom wall 20. A hydro-jet nozzle 72 is keyed to screw 60 for reciprocating thereby during rotation thereof by motor 50. Nozzle 72 may be prevented from rotating by a fixed rod 74 and includes an air inlet 76 and a water inlet 77 to which first ends 78 of flexible conduits or hoses 80, 81, respectively, are connected. An elongated opening 82 is provided in side wall 24 in fluid communication with nozzle 72 and is covered by a suitable screen 84. Motor 50 may be serviced through an access opening 92 which is provided in top wall 26 and which may be closed by a cover 94 swingably connected to top wall 26 by a hinge 96 (FIG. 4) Cover 94 may be opened by grasping a pull-ring 98 provided thereon.

Figure 3:
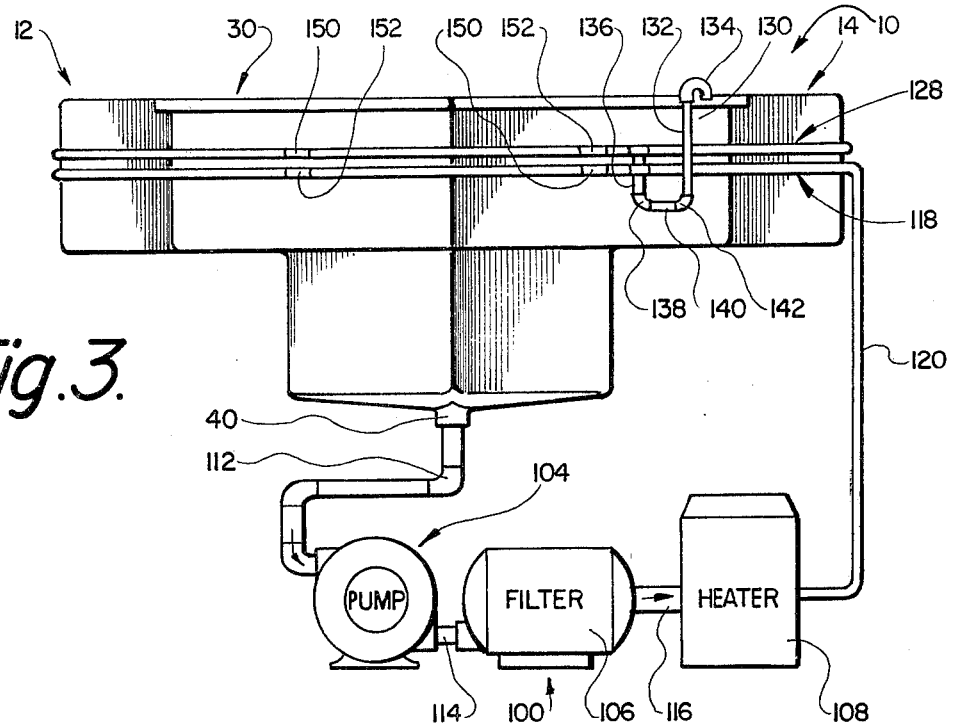
FIG. 3 is a reduced, front elevational view of the apparatus of FIG. 1 in combination with a water-and-air supply system.

Referring now to FIG. 3, hot water may be supplied to the nozzles in housings 12, 14 by a water-supply system 100 including a water pump 104, a water filter 106, and a heater 108. Water is taken from hot tub 30 through outlet 40 and is directed to the inlet side of pump 104 by a pipe 112. The discharge side of pump 104 is connected to the inlet side of filter 106 by a pipe 114 and the discharge side of filter 106 is connected to the inlet side of heater 108 by a pipe 116. The discharge side of heater 108 is connected to a water manifold 118 by a conduit 120. Manifold 118 encompasses hot tub 30 and is connected to the second end 122 of the hose 81 in each housing 12, 14 by nipples 124, 126, respectively (FIGS. 2 and 4).

Referring now to FIGS. 1–4, an air manifold 128 also encompasses hot tub 30 and receives air through an air venturi assembly 130 including an air intake pipe 138 having an inlet 134 located above the normal water level in tub 30. Intake pipe 132 is connected to manifold 128 by a first pipe 136, a first elbow 138, a second pipe 140 and a second elbow 142. Manifold 128 is connected to the second end 144 of hose 80 in each housing 12, 14 by nipples 146, 148, respectively, for supplying air to nozzles 72. Water manifold 118 and air manifold 128 are also connected to the couplings 150, 152 on a conventional jet nozzle 153 for conducting hot water and air, respectively to jet-nozzle 153.

A modified form of the apparatus of FIG. 1 will now be described in connection with FIGS. 5–12 wherein a unitary hydro-jet and fluid motor 160 is reciprocably mounted in each housing 12, 14 in fluid communication with elongated opening 24, a shown for the housing 14 in FIG. 5. Each jet and motor assembly 160 includes a housing 162 having an air inlet 164, a water inlet 165 and an outlet 166 between which a turbine wheel 168 is rotatably mounted by a boss 170 (FIG. 6), which is journaled in an end wall 172, and by an output shaft 174 journaled in a bearing 176 press-fit into a partition 178 provided in housing 162. As best shown in FIGS. 6, 7, 11 and 12, output shaft 174 carries a beveled gear 180 drivingly engaging a second beveled gear 182 carried by a collar 184 drivingly coupled to screw 60 by a key 186 (FIG. 12) carried by collar 184. Screw 60 is non-rotatably mounted in housing 14 so that jet and motor assembly 160 may be reciprocated on screw 60 when water entering inlet 165 rotates turbine wheel 168. Housing 162 is provided with a bore 188 (FIG. 7) for receiving fixed rod 74 to prevent housing 162 from rotating about screw 60.

A discharge nozzle 190 may be affixed to outlet 166 in spaced relationship therewith by a plurality of ribs 192 for drawing additional water from housing 14 into the stream discharging from outlet 166, if desired. Air inlet 164 may be connected to air manifold 128 by flexible hose 80 and nipple 146 (FIGS. 5 and 10) and water inlet 165 may be connected to water manifold 118 by house 81 and nipple 124. A check valve 194 may be provided in air inlet 164 to prevent water from flowing into hose 80.

Figure 5:
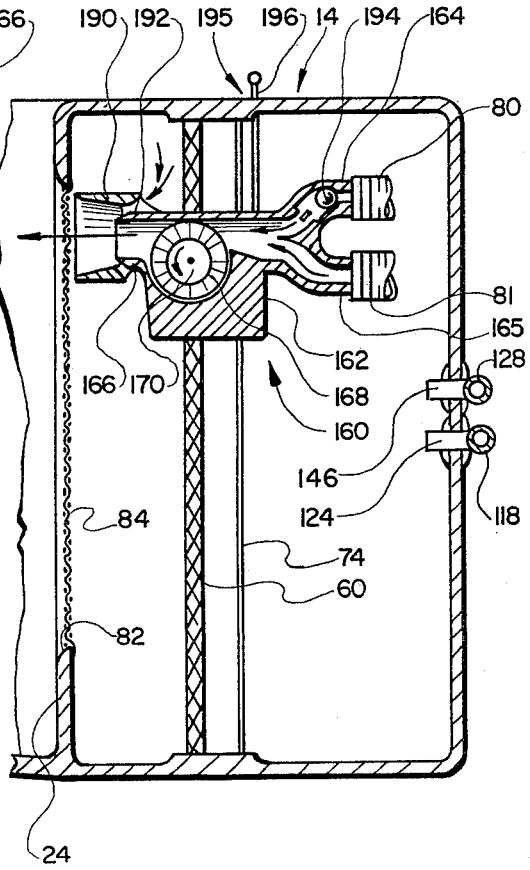
FIG. 5 is a cross-sectional view of a modified form of the hydro-massage apparatus of FIG. 1.
Figure 6:
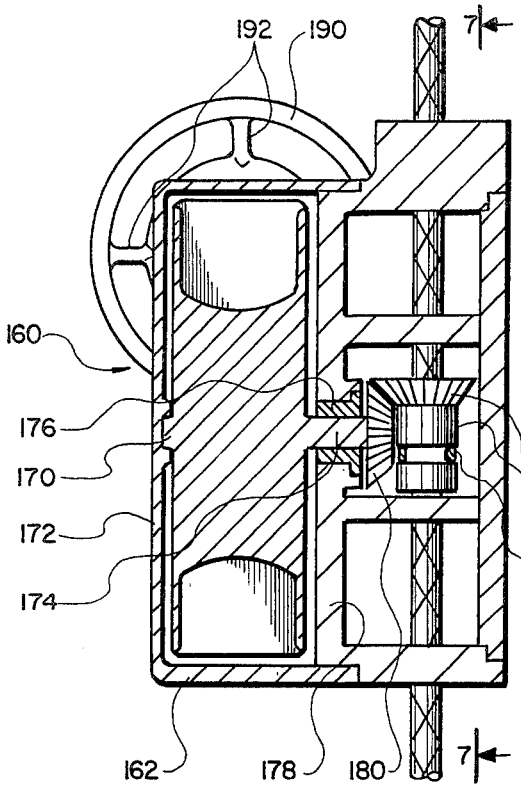
FIG. 6 is an enlarged, partial cross-sectional view of the apparatus of FIG. 5.
Figure 7:
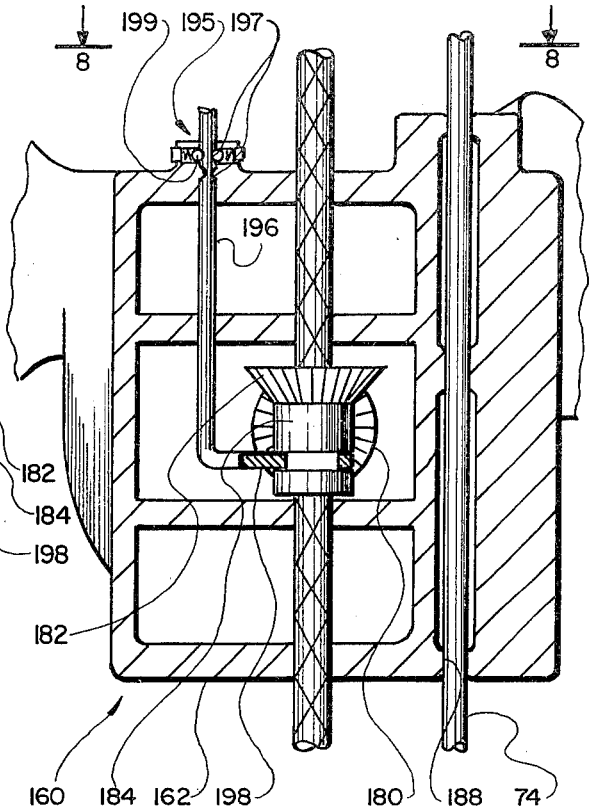
FIG. 7 is a cross-sectional view taken along line 7—7 of FIG. 6.
Figure 8:
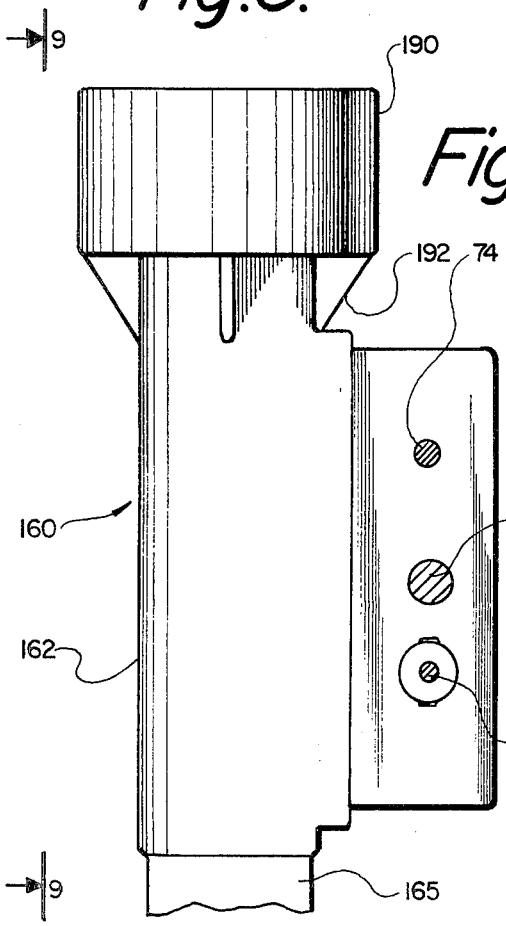
FIG. 8 is a partial top plan view taken along line 8—8 of FIG. 7.
Figure 9:
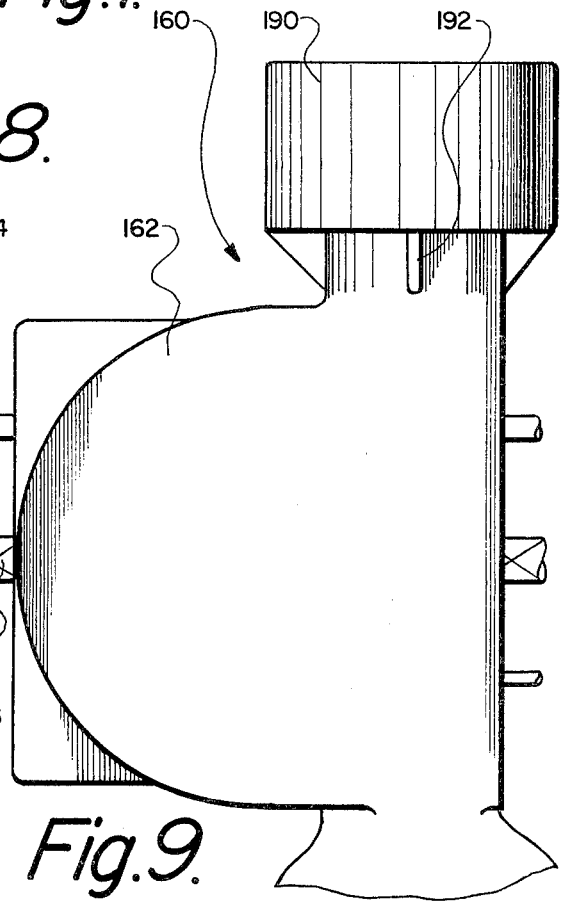
FIG. 9 is a side elevational view taken along line 9—9 of FIG. 8.
Figure 10:
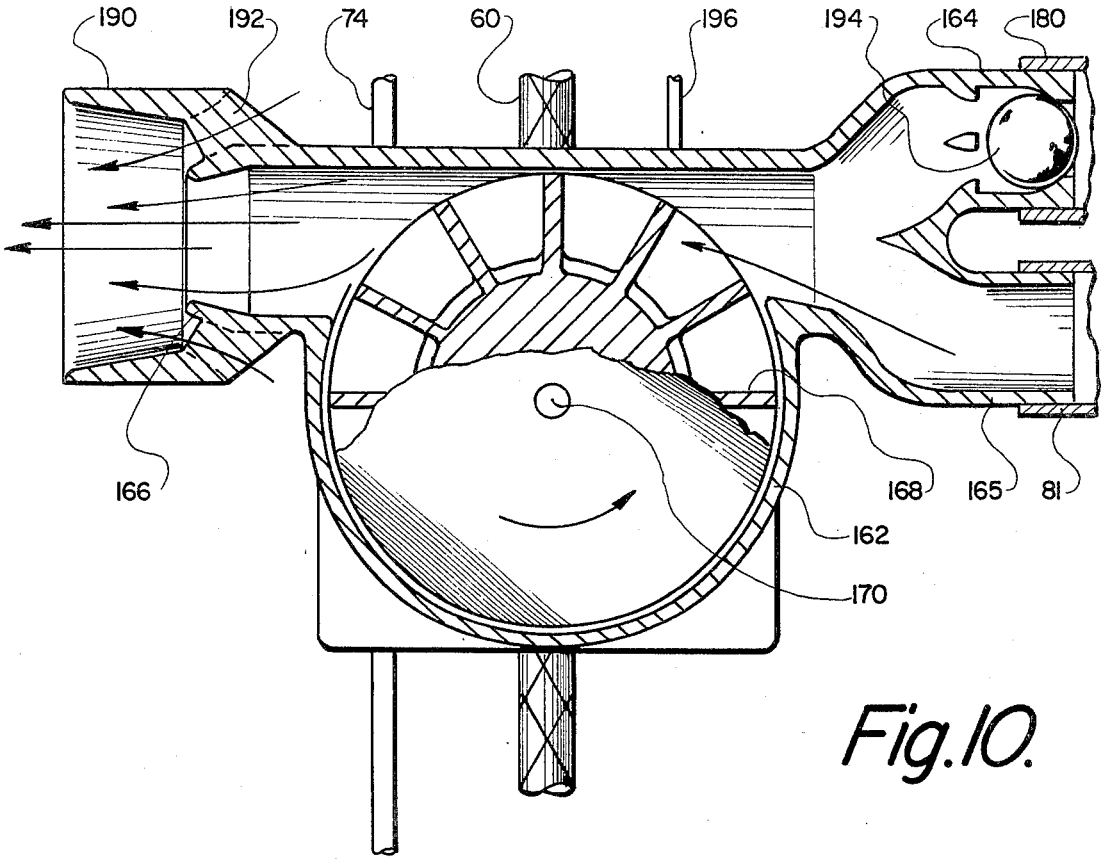
FIG. 10 is an enlarged, partial cross-sectional view of the apparatus of FIG. 5.
Figure 11:
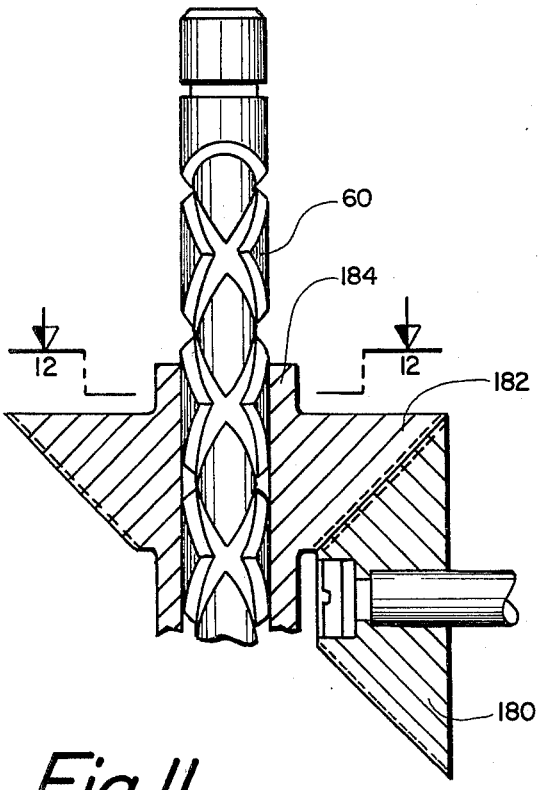
FIG. 11 is an enlarged, partial elevational view of the reciprocating mechanism for the apparatus of FIG. 5.
Figure 12:
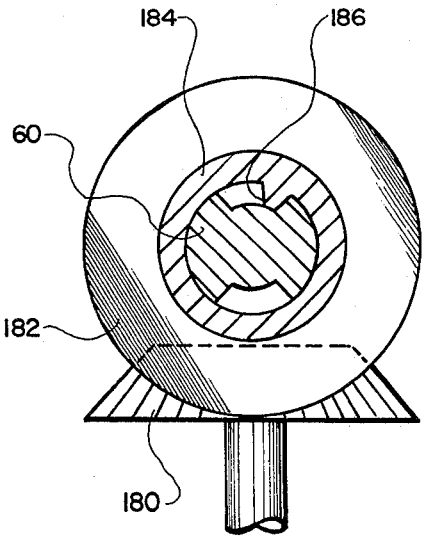
FIG. 12 is a cross-sectional view taken along line 12—12 of FIG. 11.

As shown in FIGS. 5 and 7, a shifting mechanism 195 may be provided for disengaging gear 182 from gear 180 when it is desired to have a flow of air and water without reciprocating hydro-jet 160. Mechanism 195 includes a L-shaped rod 196 having a pair of detents 197 at its upper end and a fork 198 at its lower end. Fork 198 is coupled to collar 184 on gear 182 for shifting gear 182 and detents 197 are engagable with a pair of spring-loaded ball bearings 199 which are mounted to housing 162 for holding rod 196 in shifted positions.

Operation of the first embodiment of the present invention will be described in connection with FIGS. 2, 3 and 4. Pump 104 may be energized to draw water from hot tub 30 and supply it to water manifold 118 through filter 106 and heater 108. Hot water will then be supplied to nozzles 72 and 153 for discharge into hot tub 30 through elongated openings 82 and nozzles 153, respectively. The discharge of water through nozzles 72 and 153 draws air into nozzles 72, 153 through venturi assembly 130 and air manifold 128.

Rheostats 52 may then be manipulated to energize motors 50 for driving screws 60 to continuously reciprocate nozzles 72 along openings 82, if desired. The speed of each motor may be controlled by its associated rheostat 52 for controlling the rate-of-reciprocating of an associated one of the screws 60. A user of hydro-massage apparatus 10 may sit on platform 32 in hot tub 30 and position a body part adjacent one of the openings 82 or nozzle 153 for massaging said body part.

Figure 13:
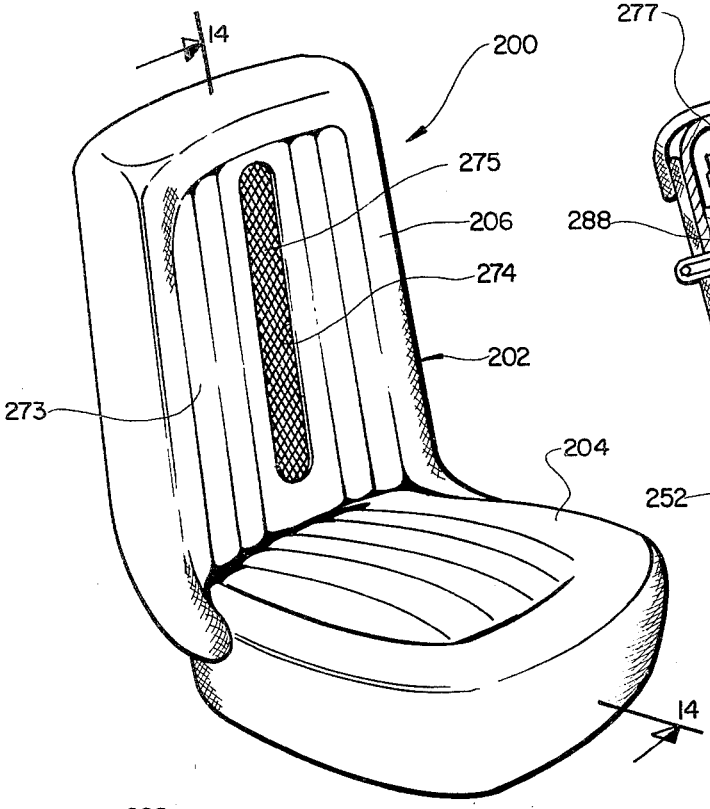
FIG. 13 is a perspective view of a hydro-massage apparatus constituting a second embodiment of the present invention.
Figure 15:
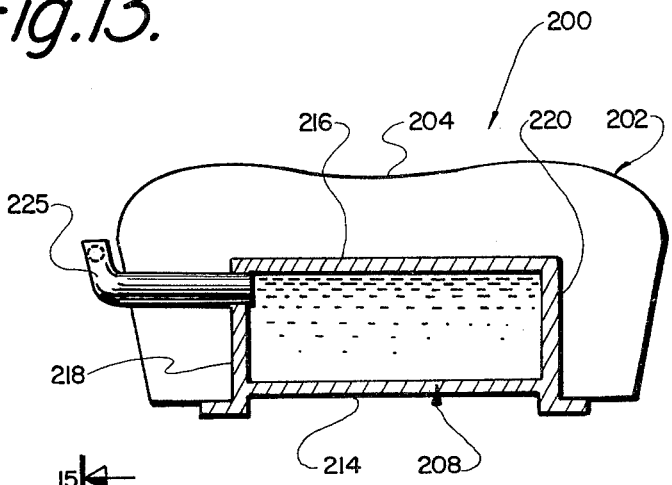
FIG. 15 is a cross-sectional view taken along line 15—15 of FIG. 14.
Figure 14:
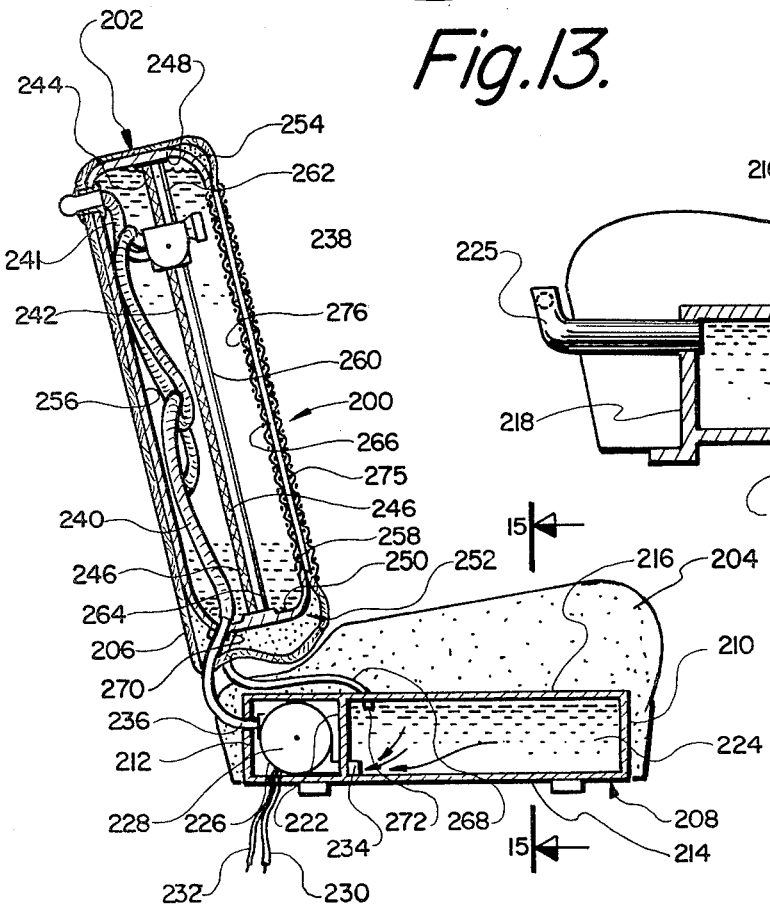
FIG. 14 is a cross-sectional view taken along line 14—14 of FIG. 13.

Referring now to FIGS. 13–15, a reciprocating hydro-massage apparatus constituting a second embodiment of the present invention, generally designated 200, includes a body supporting member 202 which is shown herein for purposes of illustration, but not of limitation, as comprising an automobile seat having a seat portion 204 and a backrest portion 206.

Apparatus 200 also includes a fluid-supply reservoir or housing 208 having a front wall 210, a rear wall 212, a bottom wall 214, a top wall 216, a first sidewall 218 and a second sidewall 220. A partition 222 divides housing 208 into a water chamber 224, which may be filled with water through a filler-neck 225, and a pump chamber 226, which houses a pump 228. Pump 228 may be connected to a suitable source of electricity by leads 230, 232 and includes a water inlet 234, extending through partition 222 into water chamber 224, and an outlet 236, which is connected to a unitary hydro-jet-fluid-motor device 238 by a flexible conduit 240.

Device 238, which may be identical to device 160, receives air through a hose 241 and is reciprocably mounted on a fixed screw 242 (like screw 60 of the first embodiment) having its upper and lower ends 244, 246, respectively, non-rotatably mounted in the top and bottom walls 248, 250, respectively, of a housing 252 including front and rear walls 254, 256. Device 238 is in fluid communication with an elongated slot 258 provide in front wall 254 and is prevented from revolving about screw 242 by a fixed rod 260 having upper and lower ends 262, 264, respectively, affixed to top and bottom walls 248, 250, respectively.

Housing 252 is mounted in backrest 206 and is placed in liquid-tight relationship therewith by a flexible diaphragm 266 affixed to front wall 254 in sealing relationship with slot 258. Water and air discharging from device 238 flexes diaphragm 266 and then returns to water chamber 224 through a conduit 268 having a first end 270 in fluid communication with housing 252 through bottom wall 250 and a second end 272 in fluid communication with housing 208 through top wall 216. Backrest 206 may be covered with a cover 273 provided with an elongated opening 274 exposing diaphragm 266 which is reenforced by a net 275. A rigid screen 276 may be provided between slot 258 and nozzle 238 for protecting a person's back from being hit by device 238 in the event of an accident.

Operation of hydro-massage apparatus 200 is believed to be apparent from the foregoing and will be briefly summarized at this point. A user of seat 202 may lean against backrest 206 and energize pump 228 whereupon device 238 will reciprocate up and down while simultaneously discharging water and air against diaphragm 266 causing it to flex into massaging engagement with the back of the user. The pressure of water discharging from pump 228 may be controlled by a rheostat (not shown) which may be connected to leads 230, 232. Additionally, shifting mechanism 195 may be used with device 238 to stop reciprocation of device 238 at any desired position on screw 242.

Figure 16:
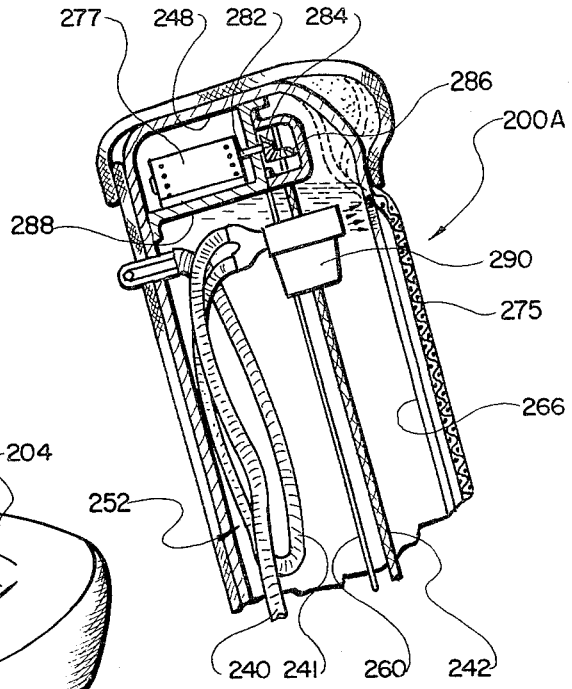
FIG. 16 is a partial cross-sectional view of a modified form of the apparatus of FIG. 13.

Referring now to FIG. 16, a modified reciprocating hydro-massage apparatus 200A is like apparatus 200 except that screw 242 is rotated by a motor 277 receiving electric current through a pair of electrical leads and a rheostat (not shown) and having its output shaft 282 driving screw 242 through bevel gears 284, 286. Motor 277 may be mounted in housing 252 on a shelf 288 provided thereon adjacent top wall 248.

Rotation of screw 242 reciprocates a jet head or nozzle 290 (like nozzle 72 of the first embodiment) connected to flexible conduits 240, 241 for receiving water from water chamber 224 (FIG. 14) and air from atmosphere, respectively.

Pump 228 may be energized to supply water and air to diaphragm 266 through slot 258 for flexing diaphragm 266. Motor 277 may then be energized to rotate screw 242 and reciprocate nozzle 290 up and down fixed rod 260, if desired.

While the particular hydro-massage devices herein shown and described in detail are fully capable of attaining the objects and providing the advantages hereinbefore stated, it is to be understood that they are merely illustrative of the presently-preferred embodiments of the invention and that no limitations are intended to the details of construction or design herein shown other than as defined in the appended claims, which form a part of this disclosure.

Whenever the term "means" is employed in these claims, this term is to be interpreted as defining the corresponding structure illustrated and described in this specification or the equivalent of the same.

What is claimed is:

1. A reciprocating hydro-massaging apparatus comprising:

a housing having at least one wall with an elongated opening provided therein, said wall having a front face and a rear face;

a nozzle reciprocably mounted in said housing adjacent said rear face of said wall in fluid communication with said elongated opening;

means coupled to said nozzle for reciprocating it with respect to said elongated opening; and means connected to said nozzle for supplying a massaging fluid to said elongated opening, whereby a user of said apparatus may position a body part adjacent said elongated opening and said front face of said wall for massaging said body part.

2. An apparatus as recited in claim 1 wherein said wall comprises the encompassing side wall of a hot tub.

3. An apparatus as recited in claim 1 including a flexible diaphragm affixed to said front face of said wall in fluid-tight relationship with said elongated opening, whereby said fluid will flex said diaphragm into massaging relationship with said body part.

4. An apparatus as recited in claim 3 including a seat having a backrest for supporting said user's back, said backrest including a front surface and a rear surface and means mounting said housing to said backrest with said diaphragm in massaging relationship with said rear surface of said backrest.

5. An apparatus as recited in claim 1 wherein said reciprocating means comprises:

a double helix screw having first and second ends;

means for journalling said ends in said housing in a manner such that the major axis of said screw lies parallel and adjacent to the major axis of said elongated slot; and a motor connected to said screw for rotating it.

6. An apparatus as recited in claim 5 wherein said motor is an electric motor.

7. An apparatus as recited in claim 5 wherein said motor is a fluid driven motor and wherein said screw is stationary.

8. In combination with a hot tub including an encompassing sidewall having an inner surface and an outer surface and an incoming water supply, the improvement which comprises:

A. An elongated slot in said sidewall; and

B. A reciprocating massaging apparatus affixed to the outer surface of said encompassing sidewall in fluid communication with said elongated slot, said apparatus comprising:

1. a housing having an open front, a rear wall, an open top and a bottom wall;
2. means affixing said housing to the outer surface of said encompassing sidewall with the open front of said housing communicating with said elongated slot;
3. a partition mounted in said housing adjacent said open top;
4. a hydro-jet-type nozzle;
5. means reciprocably mounting said nozzle in said housing in fluid communication with said elongated slot; and
6. a flexible conduit connecting said nozzle to said incoming water supply.

9. An improvement as recited in claim 8 including means for supplying air to said nozzle.

* * * * *